United States Patent [19]

Fischer

[11] 4,190,249

[45] Feb. 26, 1980

[54] TENNIS RACKET AND METHOD OF MAKING SAME

[76] Inventor: Werner Fischer, Lichtenburgerstrasse 13, 8113 Vilsbiburg, Fed. Rep. of Germany

[21] Appl. No.: 794,211

[22] Filed: May 5, 1977

[30] Foreign Application Priority Data

Jul. 31, 1976 [DE] Fed. Rep. of Germany ..... 2634599
Jul. 31, 1976 [DE] Fed. Rep. of Germany ... 7624107[U]

[51] Int. Cl.[2] ..... A63B 51/06
[52] U.S. Cl. ..... 273/73 D
[58] Field of Search ..... 273/73 R, 73 D, 73 A

[56] References Cited

U.S. PATENT DOCUMENTS

| | | | |
|---|---|---|---|
| 854,024 | 5/1907 | Brown | 273/73 D |
| 1,531,778 | 3/1925 | Gallaudet | 273/73 D |
| 1,682,199 | 8/1928 | Smilie | 273/73 D |
| 3,834,699 | 9/1974 | Pass | 273/73 D |
| 3,921,979 | 11/1975 | Dischinger | 273/73 D X |

FOREIGN PATENT DOCUMENTS

| | | | |
|---|---|---|---|
| 2143255 | 4/1973 | Fed. Rep. of Germany | 273/73 D |
| 2356972 | 5/1975 | Fed. Rep. of Germany | 273/73 D |
| 901279 | 10/1944 | France | 273/73 D |
| 300700 | 11/1928 | United Kingdom | 273/73 D |

*Primary Examiner*—Richard J. Apley
*Attorney, Agent, or Firm*—Fitch, Even & Tabin

[57] ABSTRACT

Tennis rackets and the like which are particularly adapted for transferring angular momentum to a ball, and methods for making such rackets. The rackets have a central strata of cross strings of particular arrangement and two outer strata of main strings which are laterally independent of the cross strings. The strings of the main string strata are provided with sheaths for engagement with the cross strings. The main string strata are further provided with position stabilized holding strings.

17 Claims, 3 Drawing Figures

Fig. 1.
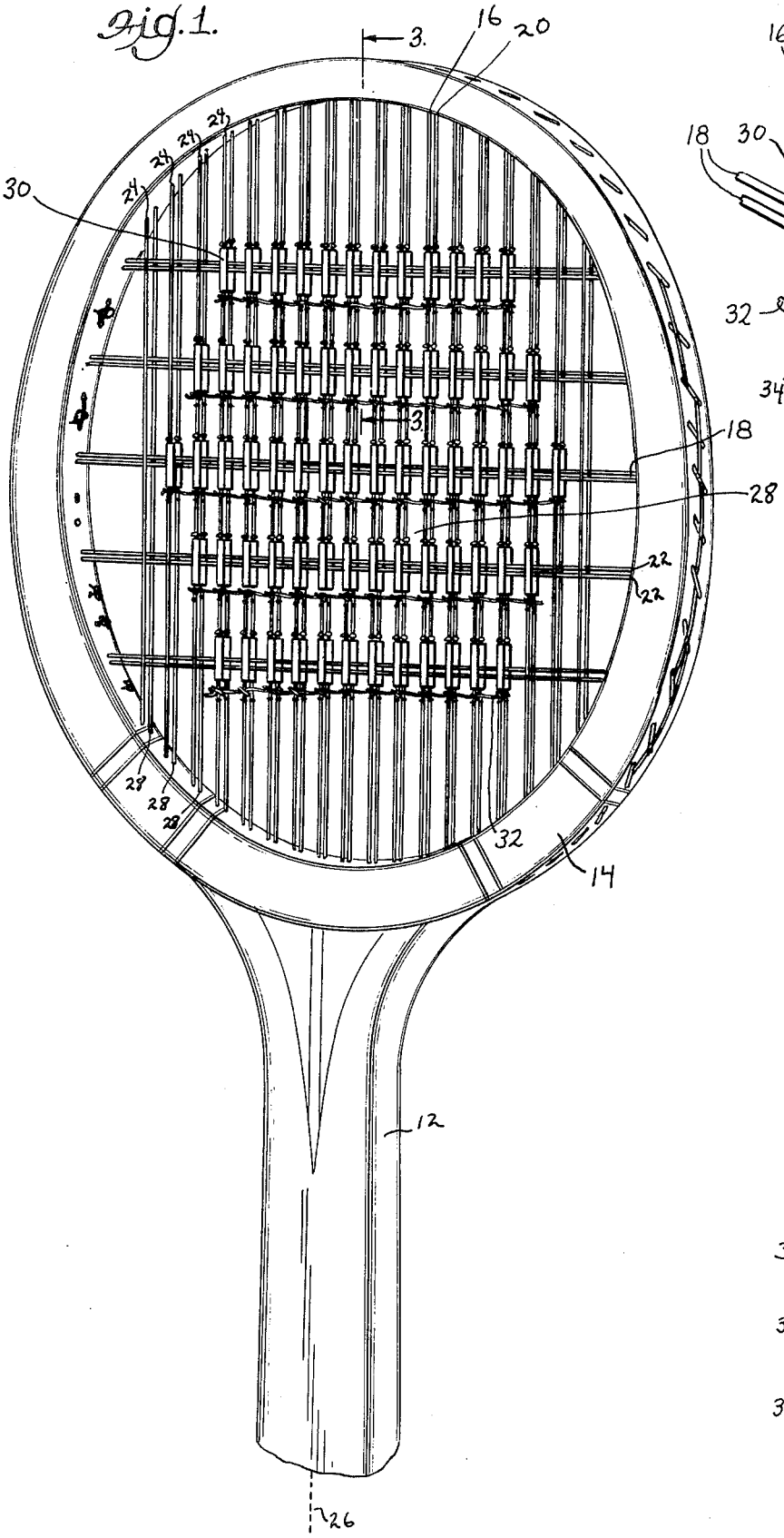
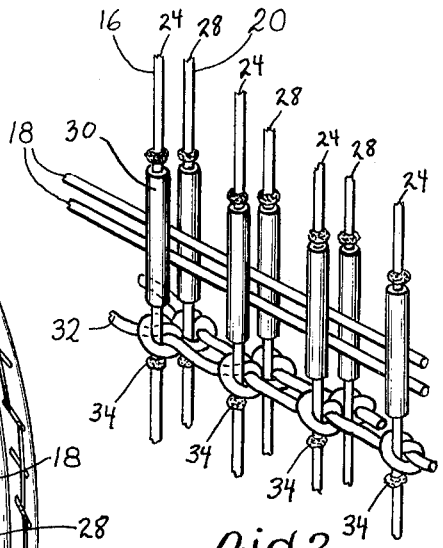
Fig. 2.
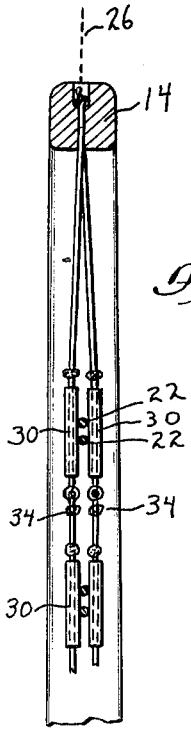
Fig. 3.

TENNIS RACKET AND METHOD OF MAKING SAME

The present invention relates to stringed rackets such as tennis rackets and, more particularly, relates to such rackets which are particularly adapted for transfer of angular momentum to a tennis ball or the like. Such rackets have particular utility for training purposes, but also may be used in regular play. The invention also relates to methods for making such rackets.

A popular technique in the game of tennis is to cut the balls. By obliquely positioning the head of the tennis racket against its path of motion, this effect may also be achieved without obliquely striking the ball, by providing the racket with a velocity component orthogonal to the impact trajectory of the ball on the racket. The balls receive an angular rotational momentum which affects the trajectory and bounce of the ball. The use of topspin causes a ball, which might otherwise land out of the court, to drop and thus stay within the court, even though it may be travelling at substantial transverse velocity. Furthermore, upon bouncing, a ball with a substantial angular velocity may receive an altered, extended or shortened trajectory, depending on whether topspin or backspin has been applied. A lateral cut, or slice, may also be applied, which has a lateral affect on the trajectory, before and after bouncing, in accordance with known principles.

In general, the technique of cutting (e.g., applying a slice, topspin or backspin) may be mastered by the average tennis player only after years of training. Furthermore, considerable skill and training is required to master the receipt and return of balls having a substantial angular velocity component.

Accordingly, a racket which is adapted for training in the application of angular momentum, and in the return of balls having angular momentum, would be very desirable. Furthermore, a racket which is particularly adapted for transfer of angular momentum to a tennis ball would be advantageous in regular play to achieve increased utilization and control of "ball spin" or angular momentum during play.

In my German Offlenlegungschrift 41 43 255.3-15 (No. 2,143,255, published Apr. 12, 1973, which is hereby incorporated by reference) there are described tennis rackets having different strata of independent longitudinal (or "main") and transverse (or "cross") strings, which were proposed for training purposes. However, while the proposed rackets have certain beneficial features, improvements therein would be desirable. Accordingly, it is an object of the present invention to provide improved tennis rackets for purposes of training or play. It is a further object to provide methods for manufacturing such rackets. These and other objects will become apparent upon consideration of the following description and the accompanying drawings, of which FIG. 1 is a perspective view of an embodiment of a tennis racket in accordance with the present invention, FIG. 2 is a perspective view of a portion of the string array of the racket of FIG. 1, and FIG. 3 is a partial cross-sectional side view of the string array of the racket of FIG. 1 taken through line 3—3.

Generally, the present invention is directed to tennis rackets and the like comprising a handle, a head, and a particular string construction which will be described in more detail hereinafter. In accordance with the present invention, the handle and head structures of the racket may be generally in accordance with conventional practice, and may, for example, be of wood or metal construction.

However, as indicated, the rackets of the present invention have a particular string construction, and in this connection, the "main", or longitudinal strings are not woven in the racket frame in intermeshed, array with the transverse or "cross" strings. Rather, a plurality of strata of strings is provided which are substantially laterally independent of each other. By "laterally independent" it is meant that the strata are not substantially restricted in movement in the plane of the strata by interaction with another independent string stratum of the racket.

More particularly, an interior cross stratum of tensioned cross strings oriented generally perpendicularly to the longitudinal axis of the racket and which are in the plane of the racket head, is provided centrally of the racket head. Two outer, main strata of tensioned, sheathed strings generally perpendicular to the longitudinal axis of the racket handle are provided immediately adjacent and on either side of the cross string stratum so that the two main strata are separated by the centrally positioned cross stratum. The main strata are adapted for ball contact, and are adapted for controlled lateral movement in respect of the central cross stratum. This lateral movement is generally in the plane of the respective main string stratum and in a direction parallel to the strings of the cross string stratum.

In order to prevent localized, uncontrolled, lateral displacement of the individual strings of the main outer strata in a differential manner, the strings of each main stratum are provided with an array of holding strings which permit retention of the freedom of the main strings to move in a direction lateral of the cross strings, but cause the main strings of a respective main string stratum to be displaced on ball contact as a unit, rather than individually. It is the purpose of the holding strings to prevent substantially differential displacement of the individual strings of the outer, main strata upon impact with the ball. In this connection, the holding strings connect individual strings of an outer, main string stratum, and are aligned generally parallel to one another orthogonal to the individual strings of the main strata. The holding strings are attached to the individual strings of the central portion of the string face where it is intended that the ball contact the racket, so that if one or more strings of the main string strata are laterally displaced by impact with the tennis ball, this lateral displacement will be transmitted by tensile force to other strings of the main string stratum through their interconnection by means of the holding string network. The holding string network, however, is not in tensile connection with the frame of the racket head. In this manner, main string strata are provided which move laterally as an array, without substantial differential distortion of the array. The main string-holding string network ensures the relatively free lateral movement of the main strings, but on the other hand, holds them together as a functional unit.

In order to prevent the holding strings from contorting in the direction of the main strings, projecting means are provided on the main strings to prevent longitudinal displacement, as will be more fully described hereinafter in connection with the illustrated embodiment.

The central cross string stratum provides a tensioned plane for resiliently resisting the ball impact, and the individual cross strings of the stratum serve as glide-strings for lateral movement of the sheathed main string strata. When the ball is being struck, the longitudinal strings of the racket are pushed in the direction of the diagonal strings and slide onto them in a manner that will be more fully discussed in connection with the illustrated embodiment of the drawings.

As a result of the deflectional movement of the main string strata, for example in topspin application, the ball may be to a certain extent hoisted during the stroke, and receives an angular momentum in a direction opposed to the deflection of the main strings. In the final phase of the stroke, the stored tensional energy of the deflected main strings, which then return to their normal position, is conveyed to the ball as angular momentum. This occurs concommitantly with the application of forward momentum to the ball as in a conventional racket.

While a conventional tennis racket having intermeshed main and cross strings may be used to apply rotational momentum to the ball, the relatively immovable surface presented by the intermeshed racket strings is not particularly effective in transferring angular momentum to the ball. Through the present invention, angular momentum is more effectively transferred between the racket and the ball, either on receipt of a spinning ball, or in the intentional application of spin upon stroking the ball.

As indicated, in order to render the tennis racket effective on both sides for enhanced angular momentum transfer (i.e., for both forehand and backhand strokes), a plurality of strata are utilized. Because momentum transfer is accomplished through lateral string displacement, and because the appropriate racket motions and/or forces generally have a principal vector component perpendicular to the longitudinal axis of the racket, properly oriented main string strata must be provided for both faces of the racket. Thus, the string array comprises three adjacent strata of strings which are substantially independent of one another, namely, a stratum of cross strings as well as frontal and posterior strata consisting of longitudinal or main, strings.

It is desirable that the main strings of the two outer strata run parallel to one another to provide for symmetrical behavior of the racket. Alternatively, the strings of the two outer strata may be aligned respectively at a relatively small angle (i.e., less than 40°, e.g., about 20°) to the axis of the racket to provide a similar effect on the forehand and backhand sides of the racket. Thus, while it is generally preferred that the main strings be parallel to the longitudinal axis of the handle of the racket, these strings may also be aligned somewhat obliquely with respect to the racket handle to maximize momentum transfer for particular racket motions. This, of course, produces rackets which have particular forehand and backhand sides.

In conventional tennis rackets, the strings are usually strung with constant tension in both the main strings and the cross strings. The strings of the rackets of the present invention may be similarly provided with a uniform tension for the cross and main strings in accordance with conventional practice in this regard. However, the different strata may also be advantageously strung at different tension levels in accordance with individual preference and/or to maximize the function of the different strata. In this connection, it is noted that a principal function of the cross string strata are the function as a tensioned layer to elastically store transverse impact energy of the racket stroke upon the ball, and to restore forward momentum to the ball upon completion of the stroke. Another principal function of the central cross string strata is to serve as a glide means for the outer main strata which is impacting with the ball.

The outer main strata function as a tensioned impact layer with respect to the translational impact energy of the ball on the racket. However, as opposed to the center cross stratum, it is also a principal function of the main strata to transmit rotational energy to the ball through lateral elastic string displacement. The separation of these functions may permit maximizing of function benefits or "tailoring" of a racket for the game or style of the individual player. The cross string strata functions may be, for example, best served by having a tension greater than that of the main string strata, with the actual tension level determined by the strength, skill or preference of the individual player in a manner similar to the determination of string tension in conventional rackets. The tension of the two respective main string strata may be determined so that the tension provides for a particular degree of lateral string displacement depending upon the degree of spin usually applied by the player in the regular course of play. In this connection, it is further noted that while only the main string stratum facing the ball is directly involved in the application of angular momentum to the ball, both of the main string strata (and the central cross stratum) directly contribute to forward momentum transfer.

Turning now to the drawings, the invention will be more particularly described with respect to the specific embodiment illustrated in FIGS. 1–3.

In FIG. 1 is illustrated in perspective view a tennis racket 10 comprising a handle 12 with a conventional grip (not shown), and a head 14 formed from an oval, closed frame.

The racket head 14 is provided with three independent string strata 16, 18, 20. The central, cross stratum 18 comprises a plurality of tensioned racket strings 22 which are generally located in central plane of symmetry of the racket head 14, which plane also intersects the longitudinal axis 26 of the racket. The strings 22 of the cross stratum 18 are arranged in parallel pairs as shown in the drawings, and are generally orthogonal to the longitudinal axis 26 of the racket. The illustrated, paired cross strings are immediately adjacent each other, being separated from the other pair members by a distance less than or equal to the diameter of the strings forming the pair. Furthermore, the cross string pairs are themselves spaced apart by a distance two or more times the spacing of the strings of the main string strata. The illustrated embodiment has a regular cross string pair spacing of three times the spacing of the strings of the main strata, 16, 20. The strings 22 of the central cross stratum of the illustrated embodiment may be conventional racket strings such as nylon strings of standard composition and size. In this connection, it will be appreciated that reference to "strings" herein may refer to an individual passage from one side of the frame to the other, it being understood that the individual strata may be strung from a single strand (or two, or several strands) having multiple passages across the frame of the racket.

Located on immediately adjacent sides of the central cross stratum 18 and in respective planes generally parallel to the plane of the cross stratum, are independent main string strata 16, 20. In the illustrated embodiment of FIG. 1, the main stratum 16 is shown as the front stratum, and the main stratum 20 is shown as the rear stratum. Because the illustrated front stratum 16 is substantially symmetrical with the rear stratum 20, the rear stratum would not be shown in a front view of the racket 10, but is visible in part in the perspective view of FIG. 1. The front main stratum 16 comprises a plurality of regularly spaced, tensioned strings 24 which are each generally parallel to the longitudinal axis 26 of the racket 10. The rear strata 20 similarly comprises a plurality of regularly spaced, tensioned strings 28 which are each also generally parallel to the longitudinal axis 26 of the racket 10, and are generally aligned with the strings 24 of the front main stratum 16 in a one-to-one correspondence. As indicated, the front and rear strata of the illustrated embodiment are substantially symmetrical with respect to the plane of the cross string stratum 18; accordingly, further description of the main string strata 16, 20 will be limited to the front stratum 16, it being understood that the description may also be applied to the rear stratum 20.

In at least the central zone 28 of the racket head where it is intended that the ball will contact the strings of the main stratum 16, the strings 24 are provided with cylindrical sheaths 30 at all contact points of the strata. The cylindrical sheaths 30 which serve as glide and separation means for the strings 24, and which may tend to facilitate more even distribution of impact forces to the cross stratum (which has a string spacing greater than that of the main string strata). The illustrated sheaths have an outer diameter of at least about one and one half times the diameter of the cross strings 22, with the sheaths of the illustrated embodiment having a diameter of about twice the diameter of the cross strings 22. The sheaths have an inner diameter corresponding to the outer diameter of the main strings 24 and are firmly affixed to the strings 24 as by a suitable adhesive so that impact is effectively transferred between strata. The sheaths should best have a length of at least about three fourths of the spacing distance 30 of the strings 24, and in the illustrated embodiment have a length about equal to the string 24 spacing. In the illustrated embodiment 10, the sheaths 30 are positioned so as to abut the cross string pairs at the longitudinal midpoint of the sheaths 30 to provide for symmetrical function of the sheaths.

The sheaths may be of any suitable, preferably low-friction material such as nylon (e.g., nylon 11). The sheath material should best have hardness at least equal to that of nylon 11 and a frictional coefficient not greater than that of nylon 11.

The front main string stratum 16 is also provided with a plurality of holding strings 32 which are oriented generally in the direction of the cross strings 22 of the center stratum 18. The holding strings are attached to the main stratum strings by knots at positions between the sheaths 30, as may be seen in more detail in FIGS. 2 and 3. As shown, the holding strings are tied to each of the main strings 24 (with the knots being adhesively strengthened if desired) to preserve the relative integrity and regularity of separation of the array of strings 24. In order to preserve the regularity of separation of holding strings 32 in a direction parallel to the axis 26 of the racket, the strings 24 are provided with means 34 projecting radially from the strings 24 and adjacent the holding strings 32. These projections, which may be applied in any suitable manner such as clamps or sheaths upon stringing and/or from solvent solution of a suitable adhesive polymeric material, prevent dislocation of the holding strings which might otherwise occur from the effects of ball impact on the racket. The projections should be of sufficient size to prevent passage of the holding strings along the main strings 24, and in the illustrated embodiment have a diameter dimension greater than the diameter of the holding string means (i.e., the knots 33) encircling the main strings 24. It should also be appreciated that sheaths 30 may function as projection means for restraining the displacement of the holding strings along the main strings, and are used for this purpose in the racket 10.

The strings of the various strata may be of standard design and may be strung through one or more planes of holes or suspension systems in the racket frame. In the illustrated embodiment, the strings are strung from one plane of holes in the racket frame. This provides a force vector, which may be appreciated from FIG. 3, which tends to press the main string strata 16, 20 against the central cross string stratum 18. The strings of the racket may be tensioned at a predetermined level, for example in the range of from about 50 to 60 pounds (e.g., about 22–28 kg.) although individual preferences may be outside of this range. As previously indicated, the tension of the various strata may be at the same or different levels, depending on various performance or preference factors.

In use, the racket 10 exhibits effective angular momentum transfer capability based on elastic lateral displacement of the main string stratum contacting the ball. Upon stroking the ball with a substantial racket velocity vector orthogonal to the incoming ball trajectory, the impacting main strings are substantially laterally displaced as a unit to retain effective ball contact and to elastically store impact energy. At the completion of the stroke, the main string stratum transfers the elastically stored energy to rotational ball motion. The racket is an effective training device for development of advanced tennis skills, and may be used to advantage in regular play.

The racket 10 may be manufactured by appropriate stringing of a conventional wood racket frame, such as the frame of a racket sold under the trade name Dunlop. The conventional string spacing holes of the racket may be used in the stringing of the racket, although it will be appreciated that hole arrangement (or string suspension designs for certain metal rackets) particularly adapted to the stringing requirements hereof may be desirable in commercial manufacturing practice.

In the manufacture of such rackets, the central stratum of strings may be strung under a desired, predetermined tension. The outer, main strata may also be strung in the racket frame at a desired, predetermined tension, with concommitant application and alignment of the cylindrical glide sheaths and/or projecting means for restraining holding string movement. The holding strings may then be attached to the main strings, either before (e.g., if solvent applied) or after application of projecting means for maintaining alignment of the holding strings.

While the present invention has been particularly described in respect of a particular embodiment, it will be appreciated that various modifications, adaptations and variations will be apparent from the present disclosure, and are intended to be within the spirit and scope of the present invention.

Various of the features of the invention are set forth in the following claims.

What is claimed is:

1. A tennis racket or the like which is particularly adapted for angular momentum transfer comprising, a racket body comprising a racket handle and a racket head frame, a central stratum in said frame of paired, tensioned cross strings, a first stratum of regularly spaced main strings in said frame adjacent one side of said cross string stratum, and a second stratum of regularly spaced main strings in said frame adjacent the other side of said cross string stratum, the spacing of said main strings being not more than about half of the spacing of said cross strings, a plurality of sheaths positioned on strings of said main string strata at points of contact between said main strata strings and said cross stratum strings in at least the central zone of said racket head frame, said sheaths having a diameter of at least about one and one half times the diameter of the cross strings and a length at least about three fourths of the center-to-center spacing of the main strings, and a set of holding strings for each of said main string strata for unifying the respective lateral movement of said main string strata, and means positioned on said main strings for preventing the displacement of said holding strings on said main strings.

2. A racket in accordance with claim 1 wherein said sheaths are nylon, and wherein said sheaths have a length about equal to the main string spacing and a diameter about twice that of the cross strings.

3. A racket in accordance with claim 1 wherein said string strata are laterally independent of each other.

4. A racket in accordance with claim 1 wherein said means for preventing displacement of said holding strings comprises a plurality of projections on said main strings in addition to said sheaths.

5. A racket in accordance with claim 4 wherein said holding strings connecting the outer main string stratum are aligned generally parallel to one another orthogonal to the strings of said main strata.

6. A racket in accordance with claim 4 wherein the holding string array is independent of tensile connection with the frame of the racket head.

7. A racket in accordance with claim 1 wherein the cross strings and the main strings are provided with a uniform tension.

8. A racket in accordance with claim 1 wherein said cross strings and said main strings are strung at different tension levels.

9. A racket in accordance with claim 1 wherein said sheaths are cylindrical and have an outer diameter of at least about one and one half times the diameter of the cross strings.

10. A racket in accordance with claim 1 wherein said sheaths have a hardness at least equal to that of nylon 11 and a frictional coefficient not greater than that of nylon 11.

11. A method for manufacturing a tennis racket which is particularly adapted for angular momentum transfer, comprising the steps of providing a tennis racket frame, stringing a strata of paired cross strings having a predetermined pairwise separation, stringing a stratum of main strings at each side of said central cross stratum to provide two independent main string strata having main strings which are regularly spaced apart with a separation distance not more than half the pairwise separation of said cross string pairs while concommitantly applying cylindrical sheaths having a diameter of at least one and one half times the cross string diameter and a length at least three fourths of the main string separation distance for intended points of contact between said main and cross strings, applying holding strings to each of said main string strata for connecting strings of said respective strata together for lateral movement as a unit, such that displacement of said holding strings along said main strings is restrained.

12. A method in accordance with claim 11 wherein said holding strings are applied to said main strings by knotting of the respective holding strings to the main strings at points of intersection therewith.

13. A method in accordance with claim 3 wherein said step of applying said sheaths comprises applying cylindrical sheaths having a hardness at least equal to that of nylon 11, a frictional coefficient not greater than that of nylon 11, a diameter of at least one and one half times the diameter of the cross strings, and a length of at least about three fourths of the center-to-center spacing of the main strings.

14. A method in accordance with claim 13 wherein a plurality of radial projections in addition to said sheaths are applied to said main strings to prevent displacement of said holding strings.

15. A method in accordance with claim 11 wherein the separation between said paired cross strings is about three times the separation between said main strings.

16. A tennis racket or the like comprising, a racket body comprising a racket handle and a racket head frame, a central stratum of cross strings in said frame, a first stratum of main strings in said frame adjacent one side of said cross string stratum, and a second stratum of main strings in said frame adjacent the other side of said cross string stratum, and a first set of holding strings independent of tensile connection with said frame, and positioned on and connecting main strings of said first main string stratum for unifying lateral movement of said first main string stratum, a second set of holding strings independent of tensile connection with said frame and positioned on and connecting main strings of said second main string stratum for unifying lateral movement of said second main string stratum, means comprising a plurality of sheaths positioned on and fastened to main strings of said first main string stratum for preventing displacement of said first set of holding strings on said first main string stratum and means comprising a plurality of sheaths positioned on and fastened to main strings of said second main string stratum for preventing displacement of said second set of holding strings on said second main string stratum.

17. A racket in accordance with claim 16 wherein said first and second sets of holding strings are aligned substantially perpendicularly to the main strings of said first and second main string strata.

* * * * *